United States Patent [19]

Trinh et al.

[11] Patent Number: 4,818,569

[45] Date of Patent: Apr. 4, 1989

[54] ARTICLES AND METHODS FOR TREATING FABRICS IN CLOTHES DRYER

[75] Inventors: Toan Trinh, Mainville; Eugene P. Gosselink; Gail B. Rattinger, both of Cincinnati, all of Ohio

[73] Assignee: The Procter & Gamble Company, Cincinnati, Ohio

[21] Appl. No.: 105,415

[22] Filed: Oct. 5, 1987

[51] Int. Cl.[4] ..... B05D 3/12

[52] U.S. Cl. ..... 427/242; 252/8.6; 428/224; 428/913

[58] Field of Search ..... 427/242; 428/224, 913; 252/8.6

[56] References Cited

U.S. PATENT DOCUMENTS

| | | | |
|---|---|---|---|
| 3,416,952 | 12/1968 | McIntyre et al. | 117/118 |
| 3,712,873 | 1/1973 | Zenk | 260/29.2 E |
| 4,238,531 | 12/1980 | Rudy et al. | 427/242 |
| 4,427,557 | 1/1984 | Stockburger | 252/8.7 |
| 4,525,524 | 6/1985 | Tung et al. | 524/601 |
| 4,749,596 | 6/1988 | Evans et al. | 427/242 |

FOREIGN PATENT DOCUMENTS 1100262 5/1981 Canada .

OTHER PUBLICATIONS

Handbook of Fiber Science and Technology: vol. 11, Chemical Processing of Fibers and Fabrics Functional Finishes Part B (Lewin & Sello) pp. 249–256.

*Primary Examiner*—James J. Bell

*Attorney, Agent, or Firm*—Robert B. Aylor; Richard C. Witte

[57] ABSTRACT

Dryer-added fabric conditioning articles and methods utilizing fabric softener agent and anionic polymeric soil release agent to provide soil release benefits with greater safety for dryer surfaces.

23 Claims, No Drawings

ARTICLES AND METHODS FOR TREATING FABRICS IN CLOTHES DRYER

TECHNICAL FIELD

The present invention encompasses articles and methods for providing soil release and softening and/or antistatic benefits to fabrics in an automatic clothes dryer.

BACKGROUND OF THE INVENTION

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See U.S. Pat. No. 3,442,692, Gaiser, issued May 6, 1969, incorporated herein by reference.)

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners provide both softening and antistatic benefits when applied to fabrics. Indeed, with fabrics such as nylon and polyester, the user is more able to perceive and appreciate an antistatic benefit than a true softening benefit.

Soil release treatment of fabrics in an automatic clothes dryer is not as common as softening treatment.

U.S. Pat. No. 4,238,531, Rudy et al., issued Dec. 9, 1980, discloses in its Examples 8 and 9 a soil release agent adjuvant plus a "distributing aid," poly(ethylene glycol) (PEG). The key combination of fabric softening plus soil release treatment in one automatic clothes dryer product is not disclosed.

U.S. patent application Ser. No. 022,615, Evans et al., filed Mar. 3, 1987, discloses dryer-added articles comprising fabric softening and soil release agents.

SUMMARY OF THE INVENTION

The present invention encompasses an article of manufacture adapted for use to provide fabric soil release benefits and to soften fabrics in an automatic laundry dryer comprising:

I. fabric treatment composition comprising:
   (a) at least an effective amount of fabric conditioning agent, preferably selected from the group consisting of cationic and nonionic fabric softening agents, and mixtures thereof; and
   (b) at least an effective amount of at least one anionic polymeric soil release agent having at least one hydrophobic moiety and at least one hydrophilic anionic moiety, and, optionally, one or more poly(oxyethylene) groups that are preferably either internal or terminated with an anionic group; and II. dispensing means for said fabric treatment composition which provides for release of an effective amounts of said fabric conditioning agent (a) and anionic soil release agent (b) to fabrics in said automatic laundry dryer at its operating temperatures, e.g., from about 35° C. to about 115° C., said agents (a) and (b), either alone or in admixture as they appear in the article of manufacture, being substantially solid under storage conditions and being mobilized under dryer conditions, and the levels of (a) and (b), as a percent of said fabric treatment composition, being from about 20% to about 95% for (a) and from about 1% to about 70% for (b).

The anionic polymeric soil release agents (anionic soil release polymers or ASRP's) typically have molecular weights of from about 500 to about 40,000, preferably from about 800 to about 10,000.

The invention encompasses a method for imparting soil releasing benefits plus a softening and/or antistatic effect to fabrics in an automatic laundry dryer comprising tumbling said fabrics under heat in said laundry dryer with an effective amount of a "fabric treatment composition" comprising (a) softening active(s), (b) said anionic soil release agent and other optional ingredients. Said fabric treatment composition also comprises the ingredients, and/or agents, applied separately to said dispensing means II. The soil release benefits for fabrics are provided for a wide range of soils including the oily types on polyester and polyester/cotton blend fabrics.

As used herein, all percentages, ratios, and parts are by weight unless otherwise stated.

DESCRIPTION OF THE PREFERRED EMBODIMENT

The present invention encompasses an article of manufacture adapted for use to provide fabric soil release benefits and/or to soften fabrics in an automatic laundry dryer comprising:

I. fabric treatment composition comprising:
   (a) one or more fabric softening agents selected from the group consisting of cationic fabric softening and/or antistatic agents, nonionic fabric softening and/or antistatic agents, and mixtures thereof; and
   (b) one or more anionic polymeric (or oligomeric) soil release agents having at least one basically hydrophobic moiety, preferably a polyester comprising terephthaloyl groups and oxyalkyleneoxy groups, and having one or more hydrophilic moieties comprising anionic groups, especially sulfonate groups, and most especially sulfoaroyl groups and sulfopoly(oxyethylene) groups [$MO_3S—(CH_2CH_2O)_n—$ wherein M is a compatible cation and n is from about 1 to about 100]; and, optionally but also preferably, one or more poly(oxyethylene) groups which are preferably either internal or terminated with said anionic groups; and II. a dispensing means which provides for release of effective amounts of said fabric conditioning agent, or agents, and soil release agent, or agents, to fabrics in said automatic laundry dryer at its operating temperatures, e.g., from about 35° C, to about 115° C., said agents (a) and (b) being, either alone or in admixture as they appear in the article of manufacture, substantially solid, but being capable of mobilization under dryer conditions, the levels, as a percent of said fabric treatment composition being from about 20% to about 95%, preferably from about 30% to about 85%, most preferably from about 40% to about 75% for (a); from about 1% to about 70%, preferably from about 10% to about 60%, most preferably from about 15% to about 50% for (b).

When the dispensing means is a flexible substrate in sheet configuration, said fabric treatment composition is releasably affixed on the substrate to provide a weight ratio of fabric treatment composition to substrate II ranging from about 10:1 to about 0.5:1, preferably from about 8:1 to about 1:1, more preferably from about 4:1 to about 1:1.

The invention also encompasses a method for imparting soil releasing benefits plus a softening and/or antistatic effect to fabrics in an automatic clothes dryer.

Anionic Polymeric Soil Release Agent

The polymeric soil release agents useful in the present invention include all anionic polymeric soil release agents. It is especially surprising that the anionic polymeric soil release agents are compatible with the cationic softener agents of this invention. However, they are compatible and effective.

The soil release agent is present at a level of from about 1% to about 70%, more preferably from about 10% to about 60%, and most preferably from about 15% to about 50%, by weight of fabric treatment composition.

The anionic polymeric soil release agents (anionic soil release polymers, or ASRP's) are more compatible with some paint or enamel dryer finishes than the corresponding nonionic soil release polymers. It is believed that this is a function of the charge which inhibits penetration of some finishes by the polymer.

Anionic polymeric (or oligomeric) soil release agents useful in the present invention have at least one basically hydrophobic moiety; at least one hydrophilic moiety comprising one or more anionic groups; and, optionally, one or more polyoxyethylene groups.

The hydrophobic moieties comprise oligomeric, or cooligomeric, or polymeric, or copolymeric esters, amides or ethers which taken as a moiety are hydrophobic. The preferred hydrophobic moieties are oligomeric or polymeric esters which comprise alternating terephthaloyl (T) groups, and (AO) groups which are oxyalkyleneoxy, preferably oxy-1,2-alkyleneoxy groups, each alkylene group containing from 2 to about 6 carbon atoms. Other uncharged dicarbonyl groups, especially other aryldicarbonyl groups can be present, at least in a small percentage. Oxyethyleneoxy, oxy-1,2-propyleneoxy, and mixtures thereof are the most preferred (AO) groups for the hydrophobic moieties.

The hydrophilic anionic moieties contain one or more covalently bonded anionic groups such as sulfonate, sulfate, carboxylate, phosphonate, or phosphate groups where said anionic groups are paired with compatible cations. The hydrophilic anionic moieties can optionally comprise nonionic hydrophilic groups in addition to the anionic groups. The preferred hydrophilic anionic moieties contain one or more sulfonate groups. The anionic moieties can either be at the ends of the polymer molecules, e.g., chains (capping groups) or positioned internally along the polymer molecules, e.g., chains. Preferred anionic capping moieties are sulfoaroyl groups, especially sulfobenzoyl groups, and sulfopolyoxyethylene groups, $MO_3S(CH_2CH_2O)_n$—, where M is preferably a compatible cation, and each n is from 1 to about 30, preferably from 1 to about 15, most preferably from 1 to about 3. Internal hydrophilic anionic moieties along the chain are preferably 5-sulfoisophthaloyl groups.

A generic empirical formula for some preferred ASRP's is $(CAP)_x(AO)_y(T)_z(I)_q(E_n)_r$ wherein: $(AO)_y$ and $(T)_z$ are combined, at least in part, to form one or more hydrophobic moieties; at least one of $(CAP)_x$ and $(I)_q$ comprises the hydrophilic anionic moiety or moieties; and $(E_n)_r$ represents the optional poly(oxyethylene) group or groups.

In the above generic empirical formula, the following definitions apply:

(I) Each (CAP) represents an end-capping moiety selected from (a) sulfoaroyl groups; (b) groups having the formula $MO_3S$—(O)$_u$—(RO)$_v$— wherein each M is a compatible cation; u is 0 or 1, preferably 0; R is either an ethylene group or mixtures of ethylene and 1,2-propylene groups, and v is from 1 to about 100, preferably from 1 to about 30, more preferably from 1 to about 15; (c) poly(oxyethylene) monoalkyl ether groups, XO—$(CH_2CH_2O)_w$—, wherein X is an alkyl group containing from 1 to about 6 carbon atoms, preferably 1 carbon atom and w is from 1 to about 100, preferably from about 6 to about 25; and (d) mixtures thereof. The end-capping moieties are preferably (a), (b), or mixtures thereof, most preferably (a) and x is from 0 to 2, preferably 1 or 2, most preferably about 2.

(II) Each (AO) represents an oxyalkyleneoxy group, excluding oxyalkyleneoxy groups of (I) and (V), containing from 2 to about 6 carbon atoms, preferably 1,2-oxyalkyleneoxy, and most preferably oxyethyleneoxy, oxy-1,2-propyleneoxy, or mixtures thereof, and y is from about 1 to about 80, preferably from about 1 to about 10, most preferably from about 1.25 to about 8.

(III) Each (T) represents a terephthaloyl group. Other noncharged dicarbonyl groups can be present, at least in a small percentage, and especially other noncharged aryl dicarbonyl groups, and z is from about 1 to about 50, preferably, from about 1 to about 10, most preferably from about 1.25 to about 8.

(IV) Each (I) represents an internal anionic group, preferably selected from the group consisting of sulfoaryldicarbonyl groups, sulfoalkylenedicarbonyl groups, and mixtures thereof. The more preferred (I) is selected from the group consisting of sulfobenzene-1,2-dicarbonyl groups; sulfobenzene-1,3-dicarbonyl groups; sulfobenzene-1,4-dicarbonyl groups; and mixtures thereof. The most preferred (I) is a 5-sulfoisophthaloyl group, and q is from 0 to about 30, preferably from 0 to about 5.

(V) Each $(E_n)$ represents a poly(oxyethylene)oxy group —$(OCH_2CH_2)_nO$— wherein each n is from 2 to about 200, preferably from about 6 to about 100, most preferably from about 10 to about 80, and r is from 0 to about 25, preferably from 0 to about 5, most preferably from 0 to about 2. In an alternate preferred structure r is from about 1 to about 2.

(VI) (CAP) and (I) are selected such that said ARSP's contain at least one anionic group.

The ASRP's typically have molecular weights of from about 500 to about 40,000, preferably from about 800 to about 10,000. ASRP's have a balance of hydrophobicity and hydrophilicity that permits them to effectively deposit on fabric surfaces.

Compatible cations include alkali metal (especially sodium and/or potassium), and substituted ammonium (e.g., mono-, di-, or triethanolammonium or tetramethylammonium) cations. Sodium is highly preferred.

These anionic polymeric soil release agents provide improved compatibility with some finishes found on clothes dryers. Improved compatibility can be achieved by minimizing poly(oxyethylene) groups, and especially poly(oxyethylene) groups at the ends of the polymer chains. However, such polymers without substantial poly(oxyethylene) content are higher melting (M.P. above about 110° C.) and therefore will have to be formulated into the product as fine powdered solids, as described hereinafter. Desirable lower melting (M.P. of less than about 80° C.) polymers have poly(oxyethylene) groups containing from about 20 to about 100 oxyethylene units. The long poly(oxyethylene) groups should be positioned between hydrophobic moieties, and/or capped with anionic groups, since it is believed that the primary damage to paint is initiated by terminal uncapped poly(oxyethylene) groups. These lower melting ASRP's can be blended with the fabric conditioning agents by melting and blending as described hereinafter. "Melting points" (M.P.) are determined by either any conventional melting point determination apparatus, or by observing the phase transition in a differential scanning calorimetry apparatus.

Specific ASRP's of interest include those of the U.S. patent application of Rene Maldonado, Toan Trinh and Eugene Paul Gosselink for SULFOAROYL END-CAPPED ESTER OLIGOMERS SUITABLE AS SOIL-RELEASE AGENTS IN DETERGENT COMPOSITIONS AND FABRIC-CONDITIONER ARTICLES, filed concurrently herewith Ser. No. 07/105,421, said application being incorporated herein by reference.

Such ASRP's include oligomeric or low molecular weight polymeric, substantially linear, sulfoaroyl end-capped esters, said esters comprising unsymmetrically substituted oxy-1,2-alkyleneoxy units, and terephthaloyl units, in a mole ratio of oxy-1,2-alkyleneoxy to terephthaloyl ranging from about 2:1 to about 1:24. (Mixtures of such esters with reaction by-products and the like retain their utility as fabric soil release agents when they contain at least 10% by weight of said linear, end-capped esters.) The preferred esters herein of relatively low molecular weight (i.e., outside the range of fiber-forming polyesters) typically ranging from about 500 to about 20,000.

The essential end-capping units of these preferred ASRP's of said Ser. No. 07/105,421, supra, are anionic hydrophiles, connected to the esters by means of aroyl groups. Preferably, the anion source is sulfonated group, i.e., the preferred end-capping units are sulfoaroyl units, especially those of the formula $(MO_3S)(C_6H_4)C(O)$—, wherein M is a compatible (especially salt-forming) cation such as Na or tetraalkylammonium.

The preferred "unsymmetrically substituted oxy-1,2-alkyleneoxy" units of the esters herein are units selected from the group consisting of (a) $—OCH(R^a)CH(R^b)O—$ units, wherein $R^a$ and $R^b$ are selected so that in each of said units, one of said groups is H and the other is a nonhydrogen R group, and (b) mixtures of the foregoing units wherein the nonhydrogen R groups are different. Mixtures of the unsymmetrical units (a) and (b) with $-(OCH_2CH_2O)-$ units are also acceptable, provided that the units taken together have, overall, a sufficiently unsymmetrical character. A convenient measure of the unsymmetrical character required is given by the mole ratio of units (a) or (b) to $—OCH_2CH_2O—$ units, which must lie in the range of about 1:10 to about 1:0. In the above, R is always a nonhydrogen, noncharged group, has low molecular weight (typically below about 500), is chemically unreactive (especially in that it is a nonesterifiable group), and is comprised of C and H, or of C, H and O. In the above-defined mixtures of units (a) or (b) with $—OCH_2CH_2O—$ units, specifically excluded are poly(oxyethylene)oxy units, i.e., $—(OCH_2CH_2)_nO—$ wherein n is a number greater than or equal to 2. [Such poly(oxyethylene)oxy units form a separate category of units which are optional, as further discussed hereinafter.] The preferred R groups are selected from the group consisting of lower n-alkyl groups, such as methyl, ethyl, propyl and butyl. Thus, the preferred oxy-1,2-alkyleneoxy units are oxy-1,2-propyleneoxy; oxy-1,2-butyleneoxy; oxy-1,2-pentyleneoxy; and oxy-1,2-hexyleneoxy units. Expecially preferred by way of oxy-1,2-alkyleneoxy units are oxy-1,2-propyleneoxy units (a), and mixtures thereof and oxyethyleneoxy units (c) in the above-defined mole ratios.

Certain noncharged, hydrophobic aryldicarbonyl units are also essential for these preferred ASRP's (Ser. No. 07/105,421, supra). Preferably, these are exclusively terephthaloyl units. Other noncharged, hydrophobic aryldicabonyl units, such as isophthaloyl or the like, can also be present if desired, provided that the soil release properties of the esters (especially polyester substantivity) are not significantly diminished.

It is also possible, optionally, to incorporate additional hydrophilic units into the esters. These can be nonionic hydrophilic units, such as poly(oxyethylene)oxy units; or, in another example, anionic hydrophilic units capable of forming two ester bonds. Suitable anionic hydrophilic units of this type are illustrated by sulfonated dicarbonyl units, such as sulfosuccinyl, i.e., $—(O)CCH(SO_3M)CH_2C(O)—$; or more preferably, sulfoisophthaloyl, i.e., $—(O)C(C_6H_3)(SO_3M)C(O)—$ wherein M is a compatible (e.g., salt-forming) cation.

Generally, herein, if it is desired to modify the units of the esters, use of additional hydrophilic units is preferable to use of additional noncharged, hydrophobic units.

Thus, preferred esters herein comprise, per mole of said ester, (i) from about 1 to about 2 moles of sulfoaroyl end-capping units (groups), preferably sulfobenzoyl end-capping units of the formula $(MO_3S)(C_6H_4)C(O)—$ wherein M is a salt-forming cation;

(ii) from about 2 to about 50 moles of oxy-1,2-propyleneoxy units or mixtures thereof with oxyethyleneoxy units or, optionally, all oxyethyleneoxy units; and (iii) from about 1 to about 40 moles of terephthaloyl units.

The "backbone" of the esters herein can further optionally comprise, per mole of said ester, (iv) from 0 to about 30 moles of sulfobenzenedicarbonyl units, preferably 5-sulfoisophthaloyl units, of the formula $—(O)C(C_6H_3)(SO_3M)C(O)—$ wherein M is a salt-forming cation; or (v) from 0 to about 25 moles of poly(oxyethylene)oxy units of the formula $—(OCH_2CH_2)_nO—$ wherein the average degree of ethoxylation n ranges from 2 to about 100; or (vi) from 0 to about 30 moles of a mixture of said units (iv) and (v) at a (iv):(v) mole ratio of from about 29:1 to about 1:29.

The end-capping sulfoaroyl units used in these esters are preferably sulfobenzoyl as in (i), and most preferably not more than about 0.15 mole fraction of said sulfobenzoyl end-capping units are in para- form. Most highly preferred are esters wherein said sulfobenzoyl end-capping units are essentially in ortho- or meta-form. Preferred end-capped esters herein are essentially in the doubly end-capped form, comprising about 2 moles of said sulfobenzoyl end-capping units per mole of said ester.

The ester "backbone" of the compositions, by definition, comprises all the units other than the end-capping units; all the units incorporated into the esters being interconnected by means of ester bonds. Thus, in one simple preferred embodiment, the ester "backbones" comprise only terephthaloyl units and oxy-1,2-propyleneoxy units. In other preferred embodiments incorporating oxyethyleneoxy units, the ester "backbone" comprises terephthaloyl units, oxy-1,2-propyleneoxy units, and oxyethyleneoxy units, the mole ratio of the latter two types of unit preferably ranging from about 1:10 to about 1:0 as previously noted. If the optional hydrophilic units, i.e., those additional to the end-capping units, e.g., poly(oxyethylene)oxy units, 5-sulfoisophthaloyl units, or mixtures thereof, are present in the backbone, they generally will comprise at least about 0.02 moles per mole of said ester.

Preferred compositions provided by the invention are illustrated by one comprising from about 25% to about 100% by weight of ester having the empirical formula $(CAP)_x(EG/PG)_y(T)_z$; wherein (CAP) represents the sodium salt form of said sulfobenzoyl end-capping units (i); (EG/PG) represents said oxyethyleneoxy and oxy-1,2-propyleneoxy units (ii); (T) represents said terephthaloyl units (iii); x is from about 1 to 2; y is from about 2.25 to about 9; z is from about 1.25 to about 8; and wherein x, y and z represent the average number of moles of the corresponding units per mole of said ester. More preferably in compositions of this type, the oxyethyleneoxy:oxy-1,2-propyleneoxy mole ratio ranges from about 1:1 to about 7:1, x is about 2, y is from about 2.25 to about 8, and z is from about 1.25 to about 7. Most highly preferred of these ester compositions comprise at least 50% by weight of said ester molecules (oligomers) having molecular weights ranging from about 600 to about 2,000.

The preparation of the aforesaid $(CAP)_x(EG/PG)_y(T)_z$ linear esters is by a process most preferably comprising reacting dimethyl terephthalate, ethylene glycol, 1,2-propylene glycol and a compound selected from the group consisting of monovalent cation salts of sulfobenzoic acid and its $C_1$–$C_4$ alkyl carboxylate esters, in the presence of at least one conventional transesterification catalyst. The resulting water-soluble or dispersible ester mixtures are used as fabric soil release materials, the best results being achieved with, but not being limited to, polyester fabrics. Another highly preferred composition herein based on water-soluble or dispersible soil release esters is provided by a process which most preferably comprises reacting dimethyl terephthalate, 1,2-propylene glycol and a compound selected from the group consisting of monovalent cation salts of sulfobenzoic acid and its $C_1$–$C_4$ alkyl carboxylate esters, in the presence of at least one conventional transesterification catalyst.

As disclosed hereinabove, the backbone of the esters herein can optionally be modified by incorporation of hydrophiles such as 5-sulfoisophthaloyl, poly(oxyethylene)oxy, and mixtures thereof. This provides compositions such as those comprising from about 25 to about 100% by weight of ester having the empirical formula $(CAP)_x(EG/PG)_y(T)_z(SIP)_q$ wherein (CAP) represents the sodium salt from of said sulfobenzoyl end-capping units (i); (EG/PG) represents said oxyethyleneoxy and oxy-1,2-propyleneoxy units (ii); (T) represents said terephthaloyl units (iii); (SIP) represents the sodium salt form of said 5-sulfoisophthaloyl units (iv); x is from about 1 to 2; y is from about 2.25 to about 39; z is from about 1 to about 34; q is from about 0.05 to about 18; and wherein x, y, z and q represent the average number of moles of the corresponding units per mole of said ester. Preferred esters of this type with 5-sulfoisophthaloyl units have the oxyethyleneoxy:oxy-1,2-propyleneoxy mole ratio ranging from about 0:1 to about 7:1; x is from about 1 to 2, y is from about 3 to about 39, z is from about 1 to about 34, and q is from about 1 to about 18, and more preferred esters have x of about 2, y of about 14, z of about 11 and q of about 2. Excellent soil release compositions are those wherein at least about 50% by weight of said ester has a molecular weight ranging from about 800 to about 20,000. In a preferred synthesis and composition in accordance with the above-defined numbers of units, water-soluble or dispersible ester mixtures are prepared by reacting dimethyl terephthalate, ethylene glycol, 1,2-propylene glycol, a dimethyl-5-sulfoisophthalate monovalent cation salt, and a compound selected from the group consisting of monovalent cation salts of sulfobenzoic acid and its $C_1$–$C_4$ alkyl carboxylate esters, in the presence of at least one conventional transesterification catalyst.

Following the same empirical nomenclature, when poly(oxyethylene)oxy units are optionally present in the backbone, the ester mixtures herein will comprise from about 25% to about 100% by weight of ester having the empirical formula $(CAP)_x(EG/PG)_y(T)_z(E_n)_r$ wherein (CAP) represents the sodium salt form of said sulfobenzoyl end-capping units (i); (EG/PG) represents said oxyethyleneoxy and oxy-1,2-propyleneoxy units (ii); (T) represents said terephthaloyl units (iii); $(E_n)$ represents said poly(oxyethylene)oxy units (v), which are further characterized in having an average degree of ethoxylation n which ranges from about 2 to about 100; x is from about 1 to 2; y is from about 2.25 to about 39; z is from about 1 to about 34; r is from about 0.05 to about 10; and wherein x, y, z and r represent the average number of moles of the corresponding units per mole of said ester. Preferably in such compositions, the oxyethyleneoxy:oxy-1,2-propyleneoxy mole ratio of said units (ii) ranges from about 0:1 to about 7:1; x is about 2, y is from about 2.25 to about 17, z is from about 1.75 to about 18 and r is from about 0.5 to about 2. More preferably, in such esters x is about 2, y is from about 4 to about 8, z is from about 4 to about 8, r is about 1 and n is from about 30 to about 85 (more preferably from about 60 to about 85; most preferably about 77). Most preferably, such ester mixtures are comprised of at about 50% by weight of said ester having molecular weights ranging from about 2,000 to about 12,000. In a preferred synthesis and composition in accordance with the above-defined numbers of units, water-soluble or dispersible ester mixtures are prepared by a process which comprises reacting dimethyl terephthalate; ethylene glycol; 1,2-propylene glycol; a poly(ethylene glycol) having an average degree of ethoxylation ranging from about 30 to about 85, and a compound selected from the group consisting of monovalent cation salts of sulfobenzoic acid and its $C_1$–$C_4$ alkyl carboxylate esters, in the presence of at least one conventional transesterification catalyst.

While it is sometimes undesirable to introduce hydrophiles such as 5-sulfoisophthalate and poly(oxyethylene)oxy groups into the esters to an extent which would prevent deposition of the esters when they are used as soil release agents, it is possible to combine these anionic and nonionic hydrophiles in the ester backbones. Thus, the invention also provides ester compositions comprising from about 25% to about 100% by weight of ester having the empirical formula $(CAP)_x(EG/PG)_y(T)_z(SIP)_q(E_n)_r$ or $(CAP)_x(PG)_y(T)_z(SIP)_q(E_n)_r$ wherein (CAP), (EG/PG) etc., are as defined hereinabove, x is from about 1 to about 2, y is from about 2.25 to about 39, z is from 1 to about 34, q is from about 0.05 to about 18, r is from about 0.05 to about 10 and n is from about 2 to about 100, the sum of q+r being a number preferably not in excess of about 20.

Molecular Geometry

These preferred esters are preferably "substantially linear", in the sense that they are not significantly branched or crosslinked by virtue of the incorporation into their structure of units being more than two ester-bond forming sites. (For a typical example of polyester branching or crosslinking, see U.S. Pat. No. 4,554,328, Sinker et al., issued Nov. 19, 1985, and incorporated by herein reference.) Furthermore, no cyclic esters are essential, but can be present in the compositions at low levels as a result of side-reactions during ester synthesis. Preferably, cyclic esters will not exceed about 2% weight of the compositions; most preferably, they will be entirely absent from the compositions.

Contrasting with the above, the term "substantially linear" as applied to the esters herein does, however, expressly encompass materials which contain side-chains which are unreactive in ester-forming or transesterification reactions. Thus, oxy-1,2-propyleneoxy units are of an unsymmetrically substituted type essential in the preferred embodiment; their methyl groups do not constitute what is conventionally regarded as "branching" in polymer technology (see Odian, Principles of Polymerization, Wiley, N.Y., 1981, pages 18–19, with which the present definitions are fully consistent), are unreactive in ester-forming reactions, and are highly desirable for the purposes of the invention. Optional units in the esters of the invention can likewise have side-chains, provided that they conform with the same nonreactivity criterion.

Molecular Units

These preferred esters comprise repeating backbone units, and end-capping units. To briefly illustrate, in the preferred embodiment, molecules of the ester are comprised of three kinds of essential units, namely (i) sulfobenzoyl end-capping units of the formula $(MO_3S)(C_6H_4)C(O)$— wherein M is a salt-forming cation;

(ii) oxy-1,2-propyleneoxy units, i.e., —$OCH(CH_3)CH_2O$— or —$OCH_2CH(CH_3)O$—, or mixtures thereof with oxyethyleneoxy units, i.e., —$OCH_2CH_2O$—. Note that the latter units are defined as excluding oxyethyleneoxy units which are connected together to form a poly(oxyethylene)oxy chain comprising two or more consecutive oxyethylene units; and (iii) terephthaloyl units, i.e., —$(O)CC_6H_4C(O)$—; note that as generally used herein, the latter formula is indicative of a

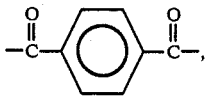

unit.

Optionally, the esters herein can also, in addition to units of types (i)–(iii), contain hydrophilic units, which can be nonionic or anionic in character. These units most preferably are (iv) 5-sulfoisophthaloyl units of the formula —$(O)C(C_6H_3)(SO_3M)C(O)$— wherein M is a salt-forming cation; and (v) poly(oxyethylene)oxy units of the formula —$(OCH_2CH_2)_nO$— wherein the average degree of ethoxylation n ranges from 2 to about 100.

Combinations of the optional units are also acceptable.

Units of the esters, which are optional in the invention as broadly defined, will be provided by well-known and readily identifiable reagents; for example, poly(ethylene glycol)s, such as PEG-3400 (degree of ethoxylation=about 77), are a suitable source of poly(oxyethylene)oxy units for use herein; and dimethyl-5-sulfoisophthalate, sodium salt, is an example of a reagent capable of providing 5-sulfoisophthaloyl units of optional incorporation into the esters of the invention. It is generally preferred that all units of the types (iv) and (v) defined hereinabove should be provided by reactants in ester or alcohol forms.

When starting with the simplest reactants as illustrated above, the overall synthesis is usually multi-step, involving at least two stages, such as an initial esterification or transesterification (also known as ester interchange) stage, followed by an oligomerization or polymerization stage, in which molecular weights of the esters are increased, but only to the limited extent specified hereinbefore.

Formation of ester-bonds involves elimination of low molecular weight by-products such as water, or simple alcohols. Complete removal of the latter from reaction mixtures is generally somewhat easier than removal of the former. However, since the ester-bond forming reactions are generally reversible, it is necessary to "drive" the reactions forward in both instances, removing these by-products.

In practical terms, in the first stage (ester interchange) the reactants are mixed in appropriate proportions and are heated, to provide a melt, at atmospheric or slightly superatmospheric pressures (preferably of an inert gas such as nitrogen or argon). Water and/or low molecular weight alcohol is liberated and is distilled from the reactor at temperatures up to about 200° C. (A temperature range of from about 150°–200° C. is generally preferred for this stage).

In the second (i.e., oligomerization) stage, vacuum or inert gas sparging techniques and temperatures somewhat higher than in the first stage are applied; removal of volatile by-products and excess reactants continues, until the reaction is complete, for example as monitored by conventional spectroscopic techniques. (Inert gas sparging which can be used in this stage involves forcing an inert gas, such as nitrogen or argon, through the reaction mixture to purge the reaction vessel of the above-mentioned volatiles; in the alternative, continuously applied vacuum, typically from about 10 mm Hg to about 0.1 mm Hg can be used; the latter technique is preferred especially when high viscosity melts are being reacted).

In both of the above-described reaction stages, it is necessary to balance on one hand the desire for rapid and complete reaction (higher temperatures and shorter times preferred), against the need to avoid thermal degradation (which undesirably might result in off-colors and by-products). It is possible to use generally higher reaction temperatures especially when reactor design minimizes super-heating or "hot spots"; also, ester-forming reactions in which ethylene glycol (rather than exclusively 1,2-propylene or high glycols) is present, are more tolerant of higher temperatures. Thus, a suitable temperature of oligomerization lies most preferably in the range of from about 150° C. to about 260° C. when ethylene glycol is present and in the range of from about 150° C. to about 240° C. when it is absent (assuming that no special precautions, such as of reactor design, are otherwise taken to limit thermolysis).

It is very important in the above-described procedure to use continuous mixing, so that the reactants are always in good contact; highly preferred procedures involve formation of a well-stirred homogeneous melt of the reactants in the temperature ranges given above. It is also highly preferred to maximize the surface area of reaction mixture which is exposed to vacuum or inert gas to facilitate the removal of volatiles, especially in the oligomerization or polymerization step; mixing equipment of a high-shear vortex-forming type and gas spargers giving good gas-liquid contact are best suited for this purpose.

Catalysts and catalyst levels appropriate for esterification, transesterification, oligomerization, and for combinations thereof, are all well-known in polyester chemistry, and will generally be used herein; as noted above, a single catalyst will suffice. Suitably catalytic metals are reported in Chemical Abstracts, CA83:178505v, which states that the catalytic activity of transition metal ions during direct esterification of K and Na carboxybenzenesulfonates by ethylene glycol decreases in the order Sn (best), Ti, Pb, Zn, Mn, Co (worst).

The reactions can be continued over periods of time sufficient to guarantee completion, or various conventional analytical monitoring techniques can be employed to monitor progress of the forward reaction; such monitoring makes it possible to speed up the procedures somewhat, and to stop the reaction as soon as a product having the minimum acceptable composition is formed.

Appropriate monitoring techniques include measurement of relative and intrinsic viscosities, acid values, hydroxyl numbers, $^{1}H$ and $^{13}C$ nuclear magnetic resonance (n.m.r.) spectra, and liquid chromatograms.

Most conveniently, when using a combination of volatile reactants (such as a glycol) and relatively involatile reactants (such as m-sulfobenzoic acid and dimethyl terephthalate), the reaction will be initiated with excess glycol being present. As in the case of ester interchange reactions reported by Odian (op. cit.), "stoichiometric balance is inherently achieved in the last stages of the second step of the process". Excess glycol can be removed from the reaction mixture by distillation; thus, the exact amount used is not critical.

Typically herein, when calculating the relative proportions of reactants to be used, the following routine is followed, as illustrated for a combination of the reactants m-sulfobenzoic acid monosodium salt (A), 1,2-propylene glycol (B) and dimethylterephthalate (C):

1. the desired degree of end-capping is selected; for the present example, the value 2, most highly preferred according to the invention, is used;
2. the average calculated number of terephthaloyl units and/or optional nonvolatile, e.g., poly(oxyethylene)oxy units, in the backbone of the desired ester are selected; for the present example, the value 3.75 for the terephthaloyl units, which falls in the range of most highly preferred values according to the invention, is used;
3. the mole ratio of (A) to (B) should thus be 2:3.75; amounts of the reactants (A) and (B) are taken accordingly;
4. an appropriate excess of glycol is selected; typically 2 to 10 times the number of moles of dimethyl terephthalate is suitable.

A section of the ratios of the various reactants will be made in accordance with the desired ratios of the resulting moieties, etc., as set forth in the various formulae herein.

More generally herein, when preparing fully end-capped ester from "simple" reactants, a ratio of the moles of end-capping reactant to moles of all other nonglycol organic reactants (e.g., in the simplest case only dimethyl terephthalate) of from about 2:1 to about 1:20, , most preferably about 1:1 to about 1:5 will be used. The glycol used will be calculated in an amount, in any event sufficient to allow interconnection of all other units by means of ester bonds, and adding a convenient excess will usually result in a total relative amount of glycol ranging from about 1.5 to about 10 moles for each mole of nonglycol organic reactants added together.

Soil release agents of this type are preferred for paint compatibility when they contain no poly(oxyethylene) blocks, or contain only short poly(oxyethylene) blocks. These soil release agents are hard, brittle solids having a high melting temperature range. These soil release agents can be pulverized into a fine powder before being mixed into, e.g., the fabric softening agent mixture. Illustrative examples of soil release agents of this type can be prepared as follows:

Soil Release Agent I

An ester composition made from m-sulfobenzoic acid monosodium salt, 1,2-propylene glycol, and dimethyl terephthalate.

Into a 500 ml, three-necked, round bottom flask, fitted with a thermometer, magnetic stirrer and modified Claisen head, the latter connected to a condenser and receiver flask, are placed, under argon, m-sulfobenzoic acid monosodium salt (50.0 g; 0.22 moles; Eastman Kodak), 1,2-propylene glycol (239.3 g; 3.14 moles; Fisher), and hydrated monobutyltin (IV) oxide (0.8 g; 0.2% w/w). Over a 2 hour period, the mixture is stirred and heated under argon at atmospheric pressure, to reach a temperature of 175° C. The reaction conditions are kept constant for an additional 16 hours, during which time distillate (4.0 g; 100% based on the theoretical yield of water) is collected. The reaction mixture is cooled to about 130° C., and dimethyl terephthalate (79.5 g; 0.41 moles; Aldrich) is added under argon. Over a 7 hour period, the mixture is stirred and heated under argon at atmospheric pressure, to reach a temperature of 175° C. The reaction conditions are kept approximately constant (temperature range 175°–180° C.) for a further 16 hours, during which time distillate (28.7 g; 110% of theory based on the calculated yield of methanol) is collected. The mixture is cooled to about 50° C. and is transferred under argon to a Kugelrohr apparatus (Aldrich). The apparatus is evacuated to a pressure of 1 mm Hg. While maintaining the vacuum and stirring, the temperature is raised to 200° C. over 1.5 hours. Reaction conditions are then held constant for about 8 hours to allow completion of the synthesis. During this period, excess glycol distills from the homogeneous mixture. (In an alternative procedure, the reaction is monitored by sampling and analysis at regular intervals, making it possible to conclude the synthesis more rapidly, the last step taking only 4 hours.)

In referring to the ester compositions of this and the following examples, the following conventions will be used:

| | | |
|---|---|---|
| (CAP) = | end-capping units | (i) |
| (PG) = | oxy-1,2-propyleneoxy units | (ii) |
| (EG/PG) = | mixture of oxyethyleneoxy and oxy-1,2-propyleneoxy units | (ii) |
| (T) = | terephthaloyl units | (iii) |
| (SIP) = | 5-sulfoisophthaloyl units | (iv) |
| $(E_n)$ = | poly(oxyethylene)oxy units, average degree of ethoxylation = n | (v) |

To illustrate the use of the convention, the known compound bis(2-hydroxypropyl) terephthalate of structure:

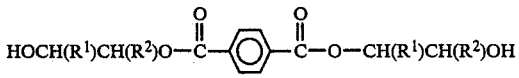

wherein $R^1$, $R^2$=H or $CH_3$; provided that when $R^1$=H, $R^2$=$CH_3$ and when $R^2$=H, $R^1$=$CH_3$, is structurally represented as:

H—(PG)—(T)—(PG)—H.

So as to be able to show the essential units and the number of each as briefly as possible, the structural representation of the same compound is further abbreviated using the empirical formula representation:

$(PG)_2(T)_1$.

It will be understood that simple nonessential groups, such as H in a terminal hydroxy group, or a methyl group of a terminal methyl ester, can be present in molecules which do not have two end-capping moieties.

Using the convention, the doubly end-capped ester composition of Soil Release Agent I has the empirical formula:

$(CAP)_2(PG)_{4.75}(T)_{3.75}$ wherein (CAP) represents m-sulfobenzoyl end-capping units in sodium salt form.

Illustrative of structures of individual oligomeric ester molecules of the Soil Release Agent I ester composition are:

(CAP)—(PG)—(T)—(PG)—(T)—(PG)—(T)—(PG)—(CAP),
(CAP)—(PG)—(T)—(PG)—(T)—(PG)—(T)—(PG)—(T)—(PG)—(CAP), ps
and (CAP)—(PG)—(T)—(PG)—(T)—(PG)—(CAP).

Soil Release Agent II

An ester composition made from m-sulfobenzoic acid monosodium salt, 1,2-propylene glycol, ethylene glycol and dimethyl terephthalate. Soil Release Agent II illustrates an ester composition useful in the present invention wherein the doubly-capped ester molecules have a "hybrid" backbone, i.e., they contain a mixture of different oxy-1,2-alkyleneoxy units.

Into a 1000 ml, three-necked, round bottom flask, fitted with a thermometer, magnetic stirrer and modified Claisen head, the latter connected to a condenser and receiver flask, are placed, under argon, m-sulfobenzoic acid monosodium salt (89.6 g; 0.40 moles; Eastman Kodak), 1,2-propylene glycol (144.6 g; 1.90 moles; Union Carbide), ethylene glycol (236.0 g; 3.80 moles; Mallinckrodt), and hydrated monobutyltin(IV) oxide (0.6 g; 0.1% w/w). Over a 5 hour period, the mixture is stirred and heated under argon at atmospheric pressure, to reach a temperature of 175° C. The reaction conditions are kept constant for an additional 16 hours, during which time distillate (12.2 g; 164% based on the theoretical yield of water) is collected. The reaction mixture is cooled to about 100° C., and dimethyl terephthalate (145.5 g; 0.75 moles; Union Carbide) is added under argon. Over a 4 hour period, the mixture is stirred and heated under argon at atmospheric pressure, to reach a temperature of 175° C. The reaction conditions are kept approximately constant (temperature range 175°–180° C.) for a further 18 hours, during which time distillate (48.9 g; 102% of theory based on the calculated yield of methanol) is collected. The mixture is cooled to about 50° C. and is transferred under argon to a Kugelrohr apparatus (Aldrich). The apparatus is evacuated to a pressure of 1 mm Hg. While maintaining the vacuum and stirring, the temperature is raised to 200° C. over 20 hours. Reaction conditions are then held constant for about 4.5 hours to allow completion of the synthesis. During this period, excess glycol distills from the homogeneous mixture.

Using the convention introduced above, this Soil Release Agent II has the empirical formula representation:

$(CAP)_2(EG/PG)_{4.75}(T)_{3.75}$.

In this representation, (CAP) represents the m-sulfobenzoyl end-capping units, in sodium salt form. The mole ratio of oxyethyleneoxy and oxy-1,2-propyleneoxy units is determined spectroscopically to be about 4:1; the volatility differential of the parent glycols is responsible for the difference between this observed ratio and the ratio predicted on the basis of moles of the two glycols used.

Illustrative of structures of oligomeric ester molecules present in the composition of Soil Release Agent II is:

(CAP)—(EG)—(T)—(PG)—(T)—(EG)—(T)—(PG)—(CAP).

Other soil release agents of this type which are particularly preferred are those that are substantially fully capped at both ends of the polymer chain with anionic groups, and have a melting point in the range of from about 35° C. to about 75° C. This melting point range allows the soil release agents to be melted and processed like typical fabric softening agents. An illustrative soil release agent of this type can be prepared as follows:

Soil Release Agent III

An ester composition is made from m-sulfobenzoic acid monosodium salt, poly(ethylene glycol)

(MW=3400), 1,2-propylene glycol and dimethyl terephthalate. Soil Release Agent III illustrates an ester composition wherein the doubly-capped ester molecules not only have sulfonated end-capping units by way of hydrophilic units, but also incorporate uncharged, i.e., nonionic, hydrophilic units in the ester backbone. Also illustrated is a catalyst addition sequence differing from that of the previous soil release agents.

Into a 250 ml, three-necked, round bottom flask, fitted with a thermometer, magnetic stirrer and modified Claisen head, the latter connected to a condenser and receiver flask, are placed, under argon, m-sulfobenzoic acid monosodium salt (13.2 g; 0.059 moles; Eastman Kodak) and 1,2-propylene glycol (35.7 g, 0.47 moles, Fisher). The mixture is stirred and heated steadily under argon at atmospheric pressure, to reach a temperature of about 200° C. The reaction conditions are kept constant, while distillate (1.06 g; 100% based on the theoretical yield of water) is collecting in the receiver flask, and the temperature is then allowed to fall to about 170°-175° C. To the clear, colorless reaction mixture are added, under argon, hydrated monobutyltin(IV) oxide (0.2 g; 0.1% w/w), dimethyl terephthalate (45.0 g; 0.23 moles: Aldrich), and $HO(CH_2CH_2O)_nH$ (100.0 g; 0.029 moles; n averages 77; m.w.=3400; Aldrich). Also added, as antioxidant, is BHT (0.2 g; Aldrich). Over 18-19 hours, the mixture is stirred and heated under argon at atmospheric pressure, at temperatures ranging from about 175°-195° C.; this reaction period is followed by a further 4 hour reaction period in which all reaction conditions, with the exception of temperature (now raised to about 200° C.), are unchanged. The methanol which is liberated in the transesterification is continuously collected. The mixture is cooled to about 50° C. and is transferred under argon to a Kugelrohr apparatus (Aldrich). The apparatus is evacuated to a pressure of 0.1 mm Hg. While maintaining the vacuum and stirring, the temperature is raised to 200° C., and the temperature is then held constant for about 10 hours to allow completion of the synthesis. (In an alternative procedure, n.m.r. spectroscopic monitoring confirms that the reaction is substantially complete after only 6-8 hours). During this period, excess glycols distill from the homogeneous mixture.

Using the convention introduced above, Soil Release Agent III has the empirical formula representation:

$$(CAP)_2(PG)_8(T)_8(E_{77})_1).$$

This product had a transition point range of from about 40° C. to about 50° C. as determined by a differential scanning calorimetry method.

Other suitable ASRP's are those described in the allowed, copending U.S. patent application of Eugene P. Gosselink for ANIONIC END-CAPPED OLIGOMERIC ESTERS AS SOIL RELEASE AGENTS IN DETERGENT COMPOSITIONS, Ser. No. 001,137, filed Jan. 7, 1987, said application being incorporated herein by reference.

Such oligomeric soil release esters having at least one anionic substituent group, said esters having the formula $$Q\text{-}[Z\text{—}O\text{—}R\text{—}O]_xZ]\text{-}Q' \text{ (di-anionic)} \qquad \text{I}$$

or $$Q''\text{-}[Z\text{—}O\text{—}R\text{—}O]_yH \text{ (mono-anionic)} \qquad \text{II}$$

or mixtures thereof; wherein Q, Q' and Q'' can be the same or different anionic substituents and are members selected from the group consisting of $MO_3S(CH_2CH_2O)_n$—, $MO_3S$—$(L)_q$—$(YO)_m$—$(CH_2CH_2O)_r$ and mixtures thereof wherein M is H or a salt-forming cation, L is phenoxyethoxy, phenoxypropoxy or $C_1$-$C_6$ alkoxy, Y is —$CH_2CH(CH_3$— or —$CH(CH_3)CH_2$—, n is an integer from 1 to 30, q is 1 or 0, m is an integer from 0 to 15 provided that m+q is at least 1, and r is an integer from 0 to 30; x and y can be the same or different and are each integers ranging from 0 to 20 and from 1 to 20, respectively; the R—substituents of the formulae I and II can be the same or different alkylene substituents selected from the group consisting of —$CH_2CH_2$—, —$CH_2CH(X)$— and —$CH(X)CH_2$— wherein X is methyl, ethyl, methoxymethyl, or $C_1$-$C_4$-alkylpoly(oxyalkylene)oxymethyl, or mixtures thereof; and the Z—substituents of the formulae can be the same or different aryldicarbonyl substituents selected from the group consisting of

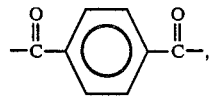

and mixtures thereof with aryl 1,3-dicarbonyl or substituted aryl-1,3-dicarbonyl or substituted aryl-1,4-dicarbonyl groups.

Particularly preferred are those mono- and di-anionic esters wherein Z is

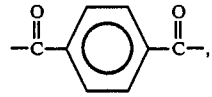

all R substituents are independently selected from —$CH_2CH_2$—, —$CH_2CH(CH_3)$— and —$CH(CH_3)CH_2$—, and Q, Q' and Q'' can be the same or different and are each selected from $NaO_3S(CH_2CH_2O)_n$— wherein n is an integer from 2 to 15, and x and y are integers of from 3 to 7 and from 4 to 8, respectively.

The content of such preferred esters, incorporating from at least four to about eight terephthalate groups in the molecular structure, is at least 2 weight percent in preferred mixtures of the esters, the compositions of which are given in more detail hereinafter.

The preferred anionic oligomeric soil release esters useful in the present invention have specific sulfoethoxylated end-caps, and are of the general formulae:

$$Q\text{-}[Z\text{—}O\text{—}R\text{—}O]_xZ]\text{-}Q' \text{ (di-anionic esters)} \qquad \text{I}$$

There should only be minimal amounts of $$Q''\text{-}[Z\text{—}O\text{—}R\text{—}O]_yH \text{ (mono-anionic esters)} \qquad \text{II}$$

In these formulae, Q, Q' amd Q'' are all capping groups selected from the group consisting of $MO_3S(CH_2CH_2O)_n$— wherein n is an integer from 1 to 30 or, more preferably, from 1 to about 15, and M is H or a salt-forming cation such as an alkali metal, ammonium, substituted ammonium, or the like.

The composition of the anionic oligomeric esters with respect to groups Q, Q′ and Q″ can be modified in four distinct ways:

(a) by selection of $MO_3S(CH_2CH_2O)_n$—containing reagent(s) used in the synthesis;
(b) by physical separation after synthesis;
(c) by mixing or blending after synthesis;
(d) by selecting anionic caps other than $MO_3S(CH_2CH_2O)_n$ or, undesirably, a proportion of a nonsulfonated poly(oxyethylene) monoalkyl ether capping reagent.

In the above, modification (a) is preferred; (b) and (c) are less convenient, and (d) is only tolerable provided that the soil release properties, paint compatibility, and formulability of the oligomeric esters are not adversely affected.

In general, practice of (a) above to arrive at particular combinations of Q, Q′ and Q″ groups can involve any of three effective variations:

(i) when each molecule of the $MO_3S(CH_2CH_2O)_n$—containing reagent used in synthesis has the same, fixed integral value of n, e.g., 3, 6, 9, or 13, then the Q, Q′ and Q″ groups of the anionic oligomeric esters will be identical, since all will have the same fixed value of n as in the reagent;
(ii) when the source of $MO_3S(CH_2CH_2O)_n$—groups is a nonfractionated or commercial ethoxylate having a statistical distribution of n values, a statistical distribution of values of n will characterize the resulting anionic oligomeric esters. Any individual oligomeric ester molecule will have any of the different, statistically allowed values of n for the different $MO_3S(CH_2CH_2O)_n$—groups. The anionic oligomeric ester mixtures resulting from the use of such commerical ethoxylates in the syntheses herein will be further characterized in having a mean or average value of n (denoted $\bar{n}$) such that $1<\bar{n}<15$. The ethoxylate distributions are expected to be skewed, monomodal distributions resembling those typically obtained in commercial ethoxylation reactions. (See N. Schonfeldt, "Surface Active Ethylene Oxide Adducts," Pergamon, New York, 1969, pp. 47–62, for further details on this subject). It is to be understood that all such compounds having the end-cap ethoxylation variations noted are useful in the practice of this invention. For cost reasons it is generally preferred to use nonfractionated commercial reagents in their synthesis;
(iii) when the source of $MO_3S(CH_2CH_2O)_n$—groups is a mixture of one or more $MO_3S(CH_2CH_2O)_n$—containing reagents having different values of n, then the Q, Q′ and Q″ groups of the resulting anionic oligomeric ester mixture will have any of the values of n allowed by the reagent mixture, the proportions being governed by the composition of the reagent mixture.

The anionic capping groups of the oligomeric esters contain a substituent M which in any individual oligomeric ester molecule may be H or a salt-forming cation. It should be recognized that, through their tendency to promote hydrolysis, high concentrations of acidic esters or acidic capping reagents can undesirably affect the stability of the oligomeric esters of the invention. For this reason, the oligomeric esters of most practical importance in the present invention ,ill generally have primarily M=Na, or similar cation, rather than M=H substitution. Most generally as prepared, however, M in each anionic oligomeric ester molecule will be selected from, e.g., H, Na, tetraalkylammonium, and mixtures thereof. The identity and proportions of M substituents arising from any synthesis will depend exclusively upon the proportion of different M substituents present in the $MO_3S(CH_2CH_2O)_n$—containing reagents used in the synthesis of the esters. However, ion exchange can be conducted on the esters to prepare esters having a variety of other M substituents, some of which would not be feasible to prepare directly, such as the ethanolammonium salts. It is, of course, understood and appreciated that in defining the esters useful in the present invention it is intended to include both the commercially accessible ethoxylate mixtures and the commercially accessible acid or salt forms of the esters, or mixtures thereof, as well as the salt forms which can result by formulating the oligomeric esters into commercial products containing salt-forming cations.

Alternative, effective anionic soil release esters useful in the present invention have anionic capping groups Q, Q′ and Q″ which are the same or different and are selected from groups $MO_3S—(L)_q—(YO)_m—(CH_2CH_2O)_r$ wherein M is H or a salt-forming cation, L is phenoxyethoxy, phenoxypropoxy or $C_1$–$C_6$ alkoxy, Y is $—CH_2CH(CH_3)—$ or $—CH(CH_3)CH_2—$, q is 1 or 0, m is an integer from 0 to 15 provided that m+q is at least 1, and r is an integer from 0 to 30. Mixtures of these alternatively capped esters with the hereinbefore defined $MO_3S(CH_2CH_2O)_n$—capped esters are likewise effective soil release agents.

The oligomeric backbones of the anionic esters of the invention comprise $-[Z—O—R—O]-$moieties, wherein the Z-substituents can be the same or different aryldicarbonyl substituents which are independently selected from the group consisting of

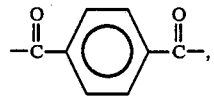

and mixtures thereof with aryl-1,3-dicarbonyl, substituted aryl-1,3-dicarbonyl or substituted aryl-1,4-dicarbonyl groups, and the R-substituents can be the same or different alkylene substituents selected from the group consisting of $—CH_2CH_2—$, $—CH_2CH(X)—$ and $—CH(X)CH_2—$ wherein X is methyl, ethyl, methoxymethyl or $C_1$–$C_4$-alkylpoly(oxyalkylene)oxymethyl, or mixtures thereof. Preferred oligomeric backbones contain

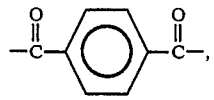

Z-substituents and exclusively ethylene, 1,2-propylene or mixtures thereof as R-substituents. Esters having at least 0.1 mole fraction of $—CH_2CH(CH_3)—$ and $—CH(CH_3)CH_2—$substituents, when the total number of moles of R substituents is taken to be 1.0, are highly preferred; the unsymmetrically placed methyl group in these 1,2-propylene substituents can (without intending to be limited by theory) have desirable effects on formulability and thereby also on soil-release effectiveness. The —Z—O—R—O—moieties can be randomly connected as in the illustrative partial formula A:

A:

$[Z'—O—R^a—O][Z^2—O—R^b—O][Z^3—O—R^c—O][Z^2—O—R^b—O—$ wherein $Z^1$, $Z^2$ and $Z^3$ are all

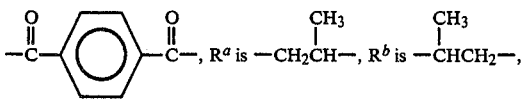

and $R^c$ is $—CH_2CH_2—$. Alternatively, the $\text{-}[Z—O—R—O]\text{-}$moieties can be connected in "blocks" such as in the illustrative formula B:

B: $\text{-}[Z'—O—R^a—O]_i[Z'—O—R^c—O]_j$ wherein Z' is

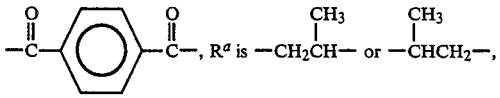

and $R^c$ is $—CH_2CH_2—$.

Formula B indicates empirically a degree of polymerization i with respect to inclusion of 1,2-propylene-derived moieties and a degree of polymerization j with respect to inclusion of ethylene-derived $\text{-}[Z—O—R—O]\text{-}$moieties. The numbers represented by i and j, used illustratively here, are directly determined by the mole fractions of the alkylene substituents. Formula B, illustrating the oligomeric backbones of certain anionic esters useful in the invention, is not necessarily restricted to backbones having only two distinct blocks; the representation includes both such a symmetrical derivative and derivatives with progressively higher randomness of structure, ultimately also including essentially random oligomers.

Most generally, no attempt is made to arrive at a particular degree of order in the oligomeric backbone. However, by adjusting parameters such as the time, temperature and proportions of particular oligomeric reactants and sequence of addition in the syntheses described more fully below, the ordering of $\text{-}[Z—O—R—O]\text{-}$ units in the backbones of the oligomeric esters could be influenced, with potential advantage for the formulability and use of the oligomeric esters as soil release agents.

The oligomeric backbones of formulae I and II indicate the overall degree of oligomerization of said backbones by integers x and y respectively. Integers x and y may be the same or different, x being selected from 0 to about 20 and y being selected from 1 to about 20. Oligomeric esters with individual integer values of x and y can be fractionated. Mixtures of esters which are inherently the result of the synthetic procedure used are preferred for cost-effectiveness and formulability and will generally be further characterized in having a particular, not necessarily integral, average degree of polymerization. It is believed that under such circumstances this average degree of polymerization will be about the same for both mono- and di-anionic esters copresent in these mixtures which are the direct result of the synthetic procedure (y will not be independent of x). The average degree of polymerization denoted $\bar{x}$ will then be in the range $0.3 \leqq \bar{x} \leqq 7$. At the molecular level, the y values in structure II will then generally coincide with x+1. However, blended compositions can be prepared in which x and y are not necessarily related variables.

Particularly preferred mono- and di-anionic esters of the invention are those wherein Z is

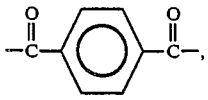

all R substituents are independently selected from $—CH_2CH_2—$, $—CH_2CH(CH_3)—$ and $—CH(CH_3)CH_2—$, Q, Q' and Q'' can be the same or different and are each selected from $NaO_3S(CH_2CH_2O)_n—$ wherein n is an integer from 1 to about 15, and x and y are integers of from 3 to 7 and from 4 to 8, respectively. The selection of M=Na in such preferred ester compositions is associated with the lower cost and environmental acceptability of this salt-forming cation.

Highly preferred mixtures of mono- and di-anionic esters of the invention comprise at least 2 weight percent of the preferred $NaO_3S(CH_2CH_2O)_n$ capped esters having four to eight terephthalate substituents, together with esters of otherwise identically defined molecular structures but containing less than four, or more than eight terephthalate units. As hereinbefore indicated, the lower molecular weight component of the latter esters is considered unlikely to be optimally fabric substantive but can be particularly effective in solubilizing the preferred anionic oligomeric esters. While not intending to be limited by theory, this can indirectly enhance the formulability and soil release effectiveness of the preferred oligomeric esters. Irrespective of theory, the ester mixtures herein are effective for the purposes of practicing the invention, and will generally have average molecular weights below about 4,000, more preferably below about 3,000.

The weight ratio of oligomeric esters having structure I (di-anionic) and structure II (mono-anionic) in preferred mixtures of mono- and di-anionic esters useful in the invention will generally be between about 30:1 and about 1:20 in preferred ester mixtures; control of such ratios is taught in the synthetic methods herein.

The sulfonated oligomeric esters useful in the present invention are typically formed from (1) ethylene glycol, 1,2-propylene glycol or a mixture thereof; (2) a compound or mixture of compounds of the formula $NaO_3S(CH_2CH_2O)_nH$ wherein n is as disclosed above; and (3) a dicarboxylic acid or its diester, dimethyl terephthalate being preferred. The respective amounts of these three component reagents are selected to prepare oligomeric esters having the desired properties in terms of formulability and soil release properties.

Component reagents $NaO_3S(CH_2CH_2O)_nH$ can be prepared by use of the method disclosed in U.S. patent application, Ser. No. 001,137, supra, incorporated herein by reference; it is anticipated that an alternative method of U.S. Pat. No. 3,823,185, Schlossman, issued July 9, 1974, and incorporated herein by reference, can equally be applicable.

Preferably, the only dicarboxylic acid derivative used is terephthalic acid or its diesters; the dimethyl ester is preferred. However, minor amounts of other aromatic dicarboxylic acids (or their diesters), or aliphatic dicarboxylic acids (or their diesters) can be included to the extent that the soil release properties are substantially maintained. Illustrative examples of other aromatic dicarboxylic acids which can be optionally used include isophthalic acid, phthalic acid, naphthalene-, anthracene- and biphenyldicarboxylic acids, as well as their dialkyl esters and mixtures of these acids. If aliphatic dicarboxylic acids are included, adipic, pimelic, azelaic, sebacic, suberic, 1,4-cyclohexanedicarboxylic and dodecanedioic acids can be used.

The preferred method for preparing the oligomeric esters of the present invention comprises: (a) transesterification (also known as ester interchange reaction) of the mixed component reagents in selected proportions and (b) polymerization of the resultant low molecular weight oligomers to the desired degree (but invariably avoiding the formation of high polymers), this step being carried out either in the originally used reaction vessel, or in a separate apparatus such as a Kugelrohr. The general reaction sequence is similar to the reactions discussed hereinbefore and is described in detail in the allowed patent application U.S. Ser. No. 001,137, supra, incorporated hereinbefore by reference.

Specific materials of the type disclosed in U.S. Ser. No. 001,137, supra, and useful in the present invention, include:

Soil Release Agent IV

An ester composition is made from dimethyl terephthalate, 1,2-propylene glycol (PG) and sodium 3,6-dioxa-8-hydroxyoctanesulfonate.

This oligomer is prepared according to the procedure of Example I of U.S. Ser. No. 001,137, supra. The resulting doubly end-capped ester composition has the empirical formula:

$$(CAP)_2(PG)_{1.75}(T)_{2.75}$$

wherein (CAP) represents a sodium 3,6-dioxa-8-oxooctanesulfonate $—OCH_2CH_2OCH_2CH_2OCH_2CH_2SO_3Na$ anionic end-capping unit. This ester composition has a melting point of about 120° C. as determined by a differential scanning calorimetry method.

Soil Release Agent V

An ester composition is made from dimethyl terephthalate, a 75:25 mole percent mixture of ethylene glycol and 1,2-propylene glycol and sodium 3,6-dioxa-8-hydroxyoctanesulfonate.

This oligomer is prepared according to the procedure of Example III of Ser. No. 001,137, supra. The resulting double end-capped ester composition has the empirical formula:

$$(CAP)_2(EG/PG)_{1.75}(T)_{2.75}$$

wherein (CAP) represents a sodium 3,6-dioxa-8-oxooctanesulfonate anionic end-capping group and the mole ratio of oxyethyleneoxy to oxy-1,2-propyleneoxy is about 3:1. This ester composition has a melting point of about 120° C. as determined by a differential scanning calorimetry method.

Soil Release Agent VI

An ester composition is made from dimethyl terephthalate, 1,2-propylene glycol and $NaO_3S(CH_2CH_2O)_n—H$ ($\bar{n}=5.9$).

This oligomer is prepared according to the procedure of Example IV of Ser. No. 001,137, supra. The resulting double end-capped ester composition has the empirical formula:

$$(CAP)_2(PG)_{1.75}(T)_{2.75}$$

wherein (CAP) represents $-(OCH_2CH_2)_{5.9}SO_3Na$ anionic end-capping group.

Mixtures prepared in the manner described in said allowed application are generally used in the consumer products disclosed herein. However, purified samples of the individual oligomeric esters sufficient for small-scale testing and evaluation as soil release agents are generally separable from the crude compositions by means of analytical techniques such as HPLC. Likewise useable in small-scale testing are blended mixtures of esters derived from separated fractions of the analytically separable esters.

Other suitable ASRP's include the oligomeric or polymeric esters selected from the group consisting of esters of type Ia, type II, and mixtures thereof, described in the copending U.S. patent application Ser. No. 061,940 of Gail B. Rattinger, Edward R. Offshack, Shaun P. Kennedy and Eugene P. Gosselink for SOIL RELEASE ESTER AND LAUNDRY COMPOSITIONS, filed June 11, 1987. Examples of the esters of type Ia are oligomers or polymers comprising a poly(oxyalkylene terephthalate) moiety capped at both ends by anionic $—(OCH_2CH_2)_nSO_3Na$ capping groups wherein n is an average number of from 1 to about 30. Examples of the esters of type II are oligomers of polymers comprising a poly(oxyalkylene terephthalate) chain capped at one end by an anionic $—(OCH_2CH_2)_nSO_3Na$ capping group with n being an average number of from 1 to about 30, and capped at the other end with a nonionic $(OCH_2CH_2)_mOCH_3$ capping groups with m being from about 12 to about 45, preferably from about 16 to about 22.

Other useful ASRP's include those having the empirical formula:

$$X(OCH_2CH_2)_n—(A—R^1—A—R^2)_u—(A—R^3—A—R^2)_v—(A—R^4—A—R^5)_w—A—R^4—A—(CH_2CH_2O)_nX$$

wherein the A moieties are essentially $$—\overset{O}{\overset{\|}{C}}—O— \text{ or } —O—\overset{O}{\overset{\|}{C}}—;$$

the $R^1$ moieties are essentially 1,4-phenylene moieties; the $R^2$ moieties are selected essentially from ethylene moieties, substituted ethylene moieties having $C_1$–$C_4$ alkyl or alkoxy substituents and mixtures thereof; the $A—R^3—A$ moieties are essentially dicarboxylic acid moieties containing at least one anionic group, such as 5-sulfoisophthalic or 2-sulfosuccinic moieties; the $R^4$ moieties are selected from the group consisting of $R^1$ and $R^3$ moieties; the $R^5$ moieties are essentially the poly(oxyethylene) moieties $—(CH_2CH_2O)_m—CH_2CH_2—$; the X groups are H or $C_1$–$C_4$ alkyl groups; n is from 1 to about 45; m is from about 5 to about 84; u is from 1 to about 30; v is from 1 to about 15; w is from 0 to about 6; u, v and w are selected such that the $R^1/R^3$ mole ratio in the average polymer molecule is from about 1:1 to about 10:1. Preferably, X is a methyl group; $R^2$ is selected from the group consisting of ethylene, 1,2-propylene or mixtures thereof; $A—R^3—A$ is sodium 5-sulfoisophthalic $—OCO—C_6H_3(SO_3Na)—COO—$group;

m is from about 13 to about 22, u is from 2 to about 10, v is from about 1 to about 3, w is from 0 to about 2, the $R^1/R^3$ mole ratio is from about 1.5:1 to about 4:1.

When n is large in the above ASRP's, i.e., when the terminal $X\text{-}(OCH_2CH_2)_n$ groups contain large numbers of oxyethylene groups, the value of v should be large to compensate. The preferred ASRP's for the purposes of this invention are those with higher melting points and/or shorter poly(oxyethylene) capping groups.

These ASRP's are described, as optional compounds, in the U.S. patent application of Eugene P. Gosselink and Francis L. Diehl for CAPPED 1,2-PROPYLENE TEREPHTHALATE-POLYOXYETHYLENE TEREPHTHALATE POLYESTERS USEFUL AS SOIL RELEASE AGENTS, Ser. No. 852,257, filed Apr. 15, 1986, said application being incorporated herein by reference.

A representative soil release agent of this type is prepared as follows.

Soil Release Agent VII

An ester composition is made from dimethyl terephthalate, dimethyl 5-sulfoisophthalate sodium salt, 1,2-propylene glycol, and polyethylene glycol monomethyl ether (MW=750).

This ester composition (soil release agent) is an anionic polymer with sulfoisophthalate negatively charged group in the polymer chain and poly(ethylene glycol) monomethyl ether nonionic capping groups at one or both ends of the polymer.

Into a 500 ml, three-necked, round bottom flask, equipped with a magnetic stirrer, inert gas inlet adaptor, thermometer, and solvent removal system, are placed, under argon, dimethyl 5-sulfoisophthalate sodium salt (98.6 g; 0.333 moles, Aldrich Chemical Co.), 1,2-propylene glycol (63.3 g; 0.832 moles; Fisher Scientific Company), hydrated monobutyltin(IV) oxide (0.2 g), and butylated hydroxytoluene (0.2 g; Aldrich Chemical Co.). This mixture is stirred and heated at 190°-200° C. for 2-4 hours to remove methanol as it forms.

At this time, poly(ethylene glycol) monomethyl ether (MW=750; 250 g; 0.333 moles; Aldrich Chemical Co.) and dimethyl terephthalate (129.3 g; 0.67 moles; Aldrich) are added to the reaction flask and heating continues for 18-24 hours while methanol is collected from this transesterification step. The reaction mixture is cooled to about 50° C. and is transferred to a 1 liter, one-necked, round bottom flask and heated for 4-8 hours on a Kugelrohr apparatus (Aldrich) at 200° C. and at 0.1 mm Hg pressure. During this period, excess glycol distills from the homogeneous mixture.

The product has the empirical formula representation:

$$(NCAP)_2(PG)_5(T)_4(SIP)_2$$

wherein (NCAP) represents the nonionic $-(OCH_2CH_2)_{16}OCH_3$ end-capping unit.

A similar material with less ethylene oxide groups in the (NCAP) group would be better for paint compatibility, but would be more difficult to incorporate into a fabric softening agent.

Other ASRP's which are useful in the present invention are copolyesters having a molecular weight of from about 1,000 to about 20,000 and comprising a copolyester of ethylene glycol, poly(ethylene glycol) having an average molecular weight of from about 200 to about 4,000, aromatic dicarboxylic acid containing only carbon, hydrogen, and oxygen atoms, and alkali metal salt of a sulfonated aromatic dicarboxylic acid containing only carbon, oxygen, hydrogen and sulfur atoms. Said copolyesters having a molecular weight of from 2,000 to 10,000 and made with poly(ethylene glycol) having an average molecular weight of from 200 to 1,000 are disclosed in U.S. Pat. No. 4,427,557, Stockburger, issued Jan. 24, 1984, incorporated herein by reference. A nonlimiting example of these copolyesters is the commercially available material Milease® HPA. Milease® HPA is sold by ICI Americas Inc. in the aqueous dispersion form containing up to 85% water. It is preferable to use the dehydrated polymer to prepare the fabric conditioning composition in order to avoid the incorporation of excess moisture which is believed to make the resulting fabric conditioning articles wet and sticky. The dehydrated polymer is obtained by drying, preferably freeze drying, the above-mentioned commercial dispersions, then pulverizing the solid into the useful powder form.

These polymers are preferred since they are high melting and do not have long poly(oxyethylene) groups.

Fabric Softening Agent

The term "fabric softening agent" as used herein includes cationic and nonionic fabric softeners used alone and also in combination with each other. A preferred fabric softening agent of the present invention is a mixture of cationic and nonionic fabric softeners.

Examples of fabric softening agents are the compositions described in U.S. Pat. Nos. 4,103,047, Zaki et al., issued July 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,037,996, Bedenk, issued Feb. 14, 1978; said patents are hereby incorporated herein by reference. Particularly preferred cationic fabric softeners of this type include quaternary ammonium salts such as dialkyl dimethylammonium chlorides, methylsulfates and ethylsulfates wherein the alkyl groups can be the same or different and contain from about 14 to about 22 carbon atoms. Examples of such preferred materials include ditallowalkyldimethylammonium methylsulfate (DTDMAMS), distearyldimethylammonium methylsulfate, dipalmityldimethylammonium methylsulfate and dibehenyldimethylammonium methylsulfate. Also particularly preferred are the carboxylic acid salts of tertiary alkylamines disclosed in said Kardouche patent. Examples include stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Another preferred type of fabric softener is described in detail in U.S. Pat. No. 4,661,269 of Toan Trinh, Errol H. Wahl, Donald M. Swartley and Ronald L. Hemingway, issued Apr. 28, 1987, and in the copending U.S. patent application to Allen D. Clauss, Gayle E. Culver, David M. Piatt and Thomas J. Wierenga, Ser. No. 058,449, filed June 5, 1987, said patent and said application being incorporated herein by reference.

Examples of nonionic fabric softeners are the sorbitan esters, described herein and $C_{12}$-$C_{26}$ fatty alcohols and fatty amines as described herein.

A preferred article of the present invention includes a fabric treatment composition which comprises 10% to 60% of anionic polymeric soil release agent, and 30% to 85% of a fabric softening agent, said fabric softening agent is selected from cationic and nonionic fabric softeners, and mixtures thereof. Preferably, said fabric softening agent comprises a mixture of about 5% to about 80% of a cationic fabric softener and about 10% to about 85% of a nonionic fabric softener by weight of said fabric treatment composition. The selection of the components is such that the resulting fabric treatment composition has a melting point above about 38° C. and being flowable at dryer operating temperatures.

It is desirable to intimately admix the ingredients of the fabric treatment before use and before application to a substrate dispensing means. This can be accomplished by premixing the ingredients by co-melting, co-milling, etc., or by combinations of such techniques. Solid materials can be preground to improve the mixing.

A preferred fabric softening agent comprises a mixture of $C_{10}$–$C_{26}$ alkyl sorbitan esters and mixture thereof, a quaternary ammonium salt and a teritary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the total fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ alkyl sorbitan monoesters and $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same of different and contain from about 14 to about 22 carbon atoms.

Another preferred fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric treatment composition. The quaternary ammonium salt is used preferably at a level of from about 5% to about 25%, and more preferably, from about 7% to about 20%, by weight of the total fabric treatment composition. The fatty alcohol can be used preferably at a level of from about 10% to about 25%, and more preferably from about 10% to about 20%, by weight of the fabric treatment composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and ethylsulfate, preferably methylsulfate. The preferred carboxylic acid salt of a tertiary alkylamine is selected from the group consisting of fatty acid salts of alkyldimethylamines wherein the alkyl group contains from about 14 to about 22 carbon atoms, and the fatty acid contains from about 14 to about 22 carbon atoms, and mixtures thereof. The preferred fatty alcohol contains from about 14 to about 22 carbon atoms.

Optional Protecting Agent

The protecting agents are materials that will distribute during the drying cycle, but which will preferentially solidify (crystallize) before any other material that is present which tends to adversely affect dryer surfaces, e.g., softening, staining and/or corroding. This protecting agent permits dryer manufacturers to have a larger selection of finishes.

Such protecting agents have the formula RBR, wherein each R is a hydrocarbon group, preferably alkyl and each B is selected from the group consisting of a single covalent bond, an ester group, an amide group, a ketone group, an ether group, and $$-\overset{O}{\overset{\|}{C}}-O(C_2H_4O)_nC-$$

wherein each n is 1 or 2, and wherein said protecting agent can be mobilized under said dryer's conditions, but will solidify, e.g., crystallize before said fabric conditioning agents.

The protecting agent is very desirable when the softening agent or the solid release agent contains polyethylene oxide linkages and especially when one, or both, are partially nonionic materials. The protecting agent provides several benefits. Where one or more of the agents will interact with the dryer surface to either soften or color it (e.g., enamel or paint surfaces), corrode it, etc., the protecting agent will minimize the adverse effect. It is believed that the protecting agents herein operate by forming a thin solid film on the surface of the dryer. Accordingly, the protecting agent should be one that mobilizes and readily spreads on the surface into a thin film, and should be in a form that permits it to solidify at the dryer surface before any other ingredient that is harmful to the dryer surface. The protecting agent should not be combined with any ingredient that will keep it a liquid under all dryer conditions. The protecting agent, or agents, should readily separate from the other ingredients and especially from those ingredients that adversely affect the dryer surface.

Suitable protecting agents are:

(a) Diesters of ethylene glycol, propylene glycol, or diethylene glycol with fatty acids containing from about 14 to about 22, preferably from about 16 to about 20, carbon atoms with the sum of the carbon atoms in the acyl groups being from about 30 to about 48, preferably from about 34 to about 40, and the melting point being from about 50° C. to about 95° C., preferably from about 60° C. to about 85° C. Specific materials include ethylene glycol distearate, ethylene glycol ditallowate, ethylene glycol dibehenate and diethylene glycol distearate.

(b) Crystalline hydrocarbons having melting points from about 50° C. to about 95° C., preferably from about 60° C. to about 85° C. Suitable materials include n-alkanes containing from about 24 to about 40, preferably from about 26 to about 36 carbon atoms, and microcrystalline waxes having melting points from about 50° C. to about 95° C., preferably from about 60° C. to about 85° C.

(c) Di (long chain alkyl) ethers, esters, ketones and amides having the formula R—A—R wherein each A is —O—, —COO—,

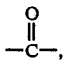

or —CONH—, and each R contains from about 14 to about 24, preferably from about 16 to about 24 carbon atoms and the sum of the carbon atoms is from about 28 to about 45, preferably from about 34 to about 45, and the melting point being from about 50° C. to about 95° C., preferably from about 60° C. to about 85° C. Suitable materials are distearyl, ditallowoyl- and dibehenyl ethers, staryl stearate, palmityl stearate, tallowyl tallowate, stearyl behenate, behenyl behenate and stearyl stearamide.

The protecting agents can be attached to substrate dispensing means separately or after admixture with any material that will allow separation and crystallization in the dryer.

A more complete disclosure of protecting agent is found in the U.S. patent application of Thomas E. Cook. Rodolfo Delgado, Carlos G. Linares, Nabil Y. Sakkab and Toan Trinh for ARTICLES AND METHODS FOR TREATING FABRICS IN CLOTHES DRYER, Ser. No. 086,116, filed Aug. 12, 1987, said application being incorporated herein by reference.

Other Optional ingredients

Well known optional components included in the fabric conditioning composition which are useful in the present invention are narrated in U.S. Pat. No. 4,103,047, Zaki et al., issued July 25, 1978, for "Fabric Treatment Compositions," incorporated herein by reference.

Very useful optional ingredients are viscosity control agents, especially particulate clays. Examples of the particulate clays useful in the present invention are described in U.S. Pat. No. 4,103,047, supra, which is incorporated herein by reference. A preferred clay viscosity control agent is calcium bentonite clay, available from Southern Clay Products under the trade name Bentolite ® L. The clay viscosity control agent is preferably present at a level of from about 0.5% to about 15%, more preferably from about 3% to about 8% by weight of the fabric conditioning composition.

Another preferred optional ingredient is perfume, which is very useful for imparting odor benefits. Perfume is preferably present at a level of from about 0.25% to about 10% by weight of the portion of the composition that is transferred to the fabrics, e.g., everything but the dispensing means.

Dispensing Means

The fabric treatment compositions can be employed by simply adding a measured amount into the dryer, e.g., as liquid dispersion. However, in a preferred embodiment, the fabric treatment compositions are provided as an article of manufacture in combination with a dispensing means such as a flexible substrate which effectively releases the composition in an automatic clothes dryer. Such dispensing means can be designed for single usage or for multiple uses.

The dispensing means will normally carry an effective amount of fabric treatment composition. Such effective amount typically provides sufficient fabric conditioning agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 10 g, most preferably from about 1 g to about 5 g.

One such article comprises a sponge material releasably enclosing enough fabric treatment composition to effectively impart fabric soil release and softness benefits during several cycles of clothes. This multi-use article can be made by filling a hollow sponge with about 20 grams of the fabric treatment composition.

Other devices and articles suitable for dispensing the fabric treatment composition into automatic dryers include those described in U.S. Pat. Nos. 4,103,047, Zaki et al., issued July 25, 1978; 3,736,668, Dillarstone, issued June 5, 1973; 3,701,202, Compa et al., issued Oct. 31, 1972, 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

A highly preferred article herein comprises the fabric treatment composition releasably affixed to a flexible substrate in a sheet configuration. Highly preferred paper, woven or nonwoven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric treatment composition from the substrate resulting in several disadvantages, one of which is uneven conditioning of the fabrics. Using a substrate with an absorbent capacity over 12 is undesirable, inasmuch as too little of the fabric treatment composition is released to condition the fabrics in optimal fashion during a normal drying cycle.

Such a substrate comprises a nonwoven cloth having an absorbent capacity of preferably from about 5 to 7 and wherein the weight ratio of fabric treatment composition to substrate on a dry weight basis ranges from about 5:1 to 1:1.

Nonwoven cloth substrate preferably comprises cellulosic fibers having a length of from 3/16 inch to 2 inches a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

Usage

The method aspect of this invention for imparting the above-described fabric treatment composition to provide soil release, softening and antistatic effects to fabrics in an automatic laundry dryer comprises: commingling pieces of damp fabrics by tumbling said fabrics under heat in an automatic clothes dryer with an effective amount of the fabric treatment composition, said composition having a melting point greater than about 38° C. and being mobilized, e.g., flowable at dryer operating temperature, said composition comprising from about 1% to 70% of a polymeric soil release agent, and 20% to 95% of a fabric conditioning agent selected from the above-defined cationic and nonionic fabric softeners and mixtures thereof.

The method herein is carried out in the following manner. Damp fabrics, usually containing from about 1 to about 3.5 times their weight of water, are placed in the drum of an automatic clothes dryer. In practice, such damp fabrics are commonly obtained by laundering, rinsing and spin-drying the fabrics in a standard washing machine. The fabric treatment composition can simply be spread uniformly over all fabric surfaces, for example, by sprinkling the composition onto the fabrics from a shaker device. Alternatively, the composition can be sprayed or otherwise coated on the dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for soil release benefits and are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a fabric treatment composition. This article is simply added to a clothes dryer together with the damp fabrics to be treated.

After one treatment in an automatic clothes dryer with an article of the present invention, the fabrics, and especially polyester fabrics, will have acquired a noticeable soil release benefit. When the said fabrics are washed in an automatic clothes washer the soil release agent is redistributed more evenly on the surface of said fabrics to provide a more uniform soil release benefit. Additional treatment cycles provide improved soil release benefits.

The following are nonlimiting examples of the instant articles and methods.

TABLE 1-A

| Ingredient | Examples: I (wt. %) | II (wt. %) | III (wt. %) |
|---|---|---|---|
| Octadecyldimethylamine | 21.65 | 21.65 | 16.73 |
| $C_{16}$-$C_{18}$ Fatty Acid | 19.97 | 19.97 | 15.44 |
| $C_{16}$-$C_{18}$ Fatty Alcohol | 17.49 | 17.49 | 13.52 |
| DTDMAMS[a] | 17.49 | 17.49 | 13.52 |
| Soil Release Agent I | 21.28 | — | — |
| Soil Release Agent II | — | 21.28 | — |
| Soil Release Agent III | — | — | 33.67 |
| Calcium Bentonite Clay[b] | 2.12 | 2.12 | 7.12 |
| Total | 100.00 | 100.00 | 100.00 |
| Article Composition: | | | |
| Substrate weight, grams/sq. yd. | 16 | 16 | 16 |
| Coating weight, grams/9" × 11" sheet | 2.4 | 2.4 | 3.0 |

| Ingredient | Examples: IV (wt. %) | V (wt. %) | VI (wt. %) |
|---|---|---|---|
| Octadecyldimethylamine | 21.65 | 21.65 | 21.65 |
| $C_{16}$-$C_{18}$ Fatty Acid | 19.97 | 19.97 | 19.97 |
| $C_{16}$-$C_{18}$ Fatty Alcohol | 17.49 | 17.49 | 17.49 |
| DTDMAMS[a] | 17.49 | 17.49 | 17.49 |
| Soil Release Agent IV | 21.28 | — | — |
| Soil Release Agent V | — | 21.28 | — |
| Soil Release Agent VI | — | — | 21.28 |
| Calcium Bentonite Clay[b] | 2.12 | 2.12 | 2.12 |
| Total | 100.00 | 100.00 | 100.00 |
| Article Composition: | | | |
| Substrate weight, grams/sq. yd. | 18 | 16 | 16 |
| Coating weight, grams/9" × 11" sheet | 2.4 | 2.4 | 2.4 |

The substrate and preparation of the examples are described hereinafter.
[a]DTDMAMS is ditallowdimethylammonium methylsulfate,
[b]Bentolite L sold by Southern Clay Products.

| Ingredient | Examples: VII (wt. %) | VIII (wt. %) | IX (wt. %) |
|---|---|---|---|
| Octadecyldimethylamine | 16.73 | 21.65 | 16.08 |
| $C_{16}$-$C_{18}$ Fatty Acid | 15.44 | 19.97 | 14.88 |
| $C_{16}$-$C_{18}$ Fatty Alcohol | 13.52 | 17.49 | 12.97 |
| DTDMAMS[a] | 13.52 | 17.49 | — |
| Sorbitan Monostearate | — | — | 12.97 |
| Soil Release Agent VII | 33.67 | — | — |
| Milease HPA[c] | — | 21.28 | — |
| Soil Release Agent III | — | — | 34.25 |
| Calcium Bentonite Clay[b] | 7.12 | 2.12 | 6.10 |
| Perfume | — | — | 2.75 |
| Total | 100.00 | 100.00 | 100.00 |
| Article Composition: | | | |
| Substrate weight, grams/sq. yd. | 16 | 16 | 16 |
| Coating weight, grams/9" × 11" sheet | 3.0 | 2.4 | 3.0 |

The substrate and preparaton of the examples are described hereinafter.
[a]DTDMAMS is di(tallowalkyl)dimethylammonium methylsulfate,
[b]Bentolite L sold by Southern Clay Products.
[c]Freeze-dried form of Milease HPA, an anionic soil release polymer obtained from ICI Americas. It is described herein above in the section entitled "Anionic Polymeric Soil Release Agent."

The following typical procedures are representative of the procedures used to prepare Examples I–IX:

PROCEDURE A

Sample Preparation of Fabric Treatment Compositions and Fabric Conditioning Articles Containing Solid Anionic Soil Release Agent Powder The solid anionic soil release agent is pulverized and sieved through a 200 mesh screen to obtain the anionic soil release agent powder.

Preparation of the Coating Mix

A blend of 21.65 parts of octadecyldimethylamine (Ethyl Corp.) and 19.97 parts of $C_{16}$–$C_{18}$ fatty acid (Emery Industries, Inc.) is melted at 80° C., and a blend of 17.49 parts of $C_{16-18}$ fatty alcohol (Ethyl Corp.) and 17.49 parts of DTDMAMS (Sherex Chemical Co.) is melted at 80° C. The two blends are then mixed together to form the softener component of the formula. The calcium bentonite clay (2.12 parts, Bentolite L from Southern Clay Co.) is added slowly with mixing and the mixture is stirred well. Next, the anionic soil release polymer powder (21.28 parts) is added slowly while mixing, while the temperature of the softener is kept between 70°–80° C. using a water bath, until all of the polymer powder has been mixed into the softener matrix.

Preparation of Fabric Conditioning Sheets

The coating mixture is applied to preweighed nonwoven substrate sheets of a 9 inch×11 inch (approximately 23×28 cm.) dimension. The substrate sheets are comprised of 70% 3-denier, 1-9/16 inch (approximately 4 cm.) long rayon fibers with 30% polyvinyl acetate binder. A small amount of formula is spread on a heated metal plate with a spatula and a nonwoven sheet is placed on it to absorb the coating mixture. More mixture is added to the sheet by using a spatula to evenly distribute it onto the sheet. The sheet is then removed from the heated metal plate and allowed to cool to room temperature so that the coating mix can solidify. The sheet is weighed to determine the amount of coating mixture on the sheet. The target coating is 2.4 g per sheet. Each sheet contains 0.5 g of soil release polymer. If the weight is in excess of the target weight, the sheet is placed back on the heated metal plate to remelt the coating mixture and remove some of the excess. If the weight is under the target weight, the sheet is also placed on the heated metal plate and more coating mixture is added.

Alternatively, but not necessarily preferably, the powdered ASRP can be sprinkled on a sheet bearing molten softener.

PROCEDURE B

Sample Preparation of Fabric Treatment Compositions and Fabric Conditioning Articles Containing Lower Melting Soil Release Agents Preparation of the Coating Mix A blend of 16.73 parts octadecyldimethylamine (Ethyl Corp.) and 15.44 parts $C_{16}$–$C_{18}$ fatty acid (Emery Industries, Inc.) is melted at 80° C., and a blend of 13.52 parts $C_{16}$–$C_{18}$ fatty alcohol (Ethyl Corp.) and 13.52 parts DTDMAMS (Sherex Chemical Co.) are melted together at 80° C. The anionic soil release agent (33.67 parts) is also melted at 80° C. The blends are then mixed together to form the softener component of the formula. This molten softener is added to the molten soil release polymer and the mixture is high shear mixed using a Gifford-Wood Model 1L Laboratory Homogenizer (Greerco Corp., Hudson, N.H.) for about 3 minutes during which time the mixture is kept molten in a boiling water bath. The calcium bentonite clay (7.12 parts of Bentolite L, available from Southern Clay Co.) is then slowly added to the mixture while high shear mixing, and the formula is mixed until the mixture is smooth and completely homogeneous.

Preparation of Fabric Conditioning Sheets

The coating mixture is applied to preweighed nonwoven substrate sheets of a 9 inch×11 inch (approximately 23×28 cm.) dimension. The substrate sheets are comprised of 70% 3-denier, 1-9/16 (approximately 4 cm) inch long rayon fibers with 30% polyvinyl acetate binder. A small amount of formula is placed on a heated metal plate with a spatula and then is spread evenly with a small metal roller. A nonwoven sheet is placed on the metal plate to absorb the coating mixture. The mixture is spread evenly over the sheet using the same metal roller. The sheet is then removed from the heated metal plate and allowed to cool to room temperature so that the coating mix can solidify. The sheet is weighed to determine the amount of coating mixture on the sheet. The target coating is 3.0 g per sheet. Each sheet contains 1.0 g of soil release polymer. If the weight is in excess of the target weight, the sheet is placed back on the heated metal plate to remelt the coating mixture and remove some of the excess. If the weight is under the target weight, the sheet is also placed on the heated metal plate and more coating mixture is added.

EXAMPLE I

The composition and article of Example I are prepared by Procedure A, using Soil Release Agent I.

EXAMPLE II

The composition and article of Example II are prepared by the procedure of Example I, with the exception that Soil Release Agent II is used instead of Soil Release Agent I.

EXAMPLE III

The composition and article of Example III are prepared by Procedure B, using Soil Release Agent III.

EXAMPLES IV AND V

The compositions and articles of Examples IV and V are prepared by Procedure A using Soil Release Agents IV and V, respectively.

EXAMPLE VI

The composition of Example VI is made by a procedure similar to Procedure B. The coating mixture is applied to the nonwoven substrate with a spatula. The target coating weight is 2.6 g per sheet with each sheet containing 0.5 g of soil release agent.

EXAMPLE VII

The composition and article of Example VII are prepared by Procedure B of Example III, with the exception that Soil Release Agent VII is used instead of Soil Release Agent III.

EXAMPLE VIII

The composition and article of Example VIII are prepared by Procedure A, using the commercial Soil Release Agent Milease HPA which is first freeze-dried, pulverized and sieved through a 200 mesh screen to obtain the powder.

EXAMPLE IX

A dryer-added fabric conditioning article comprising a rayon nonwoven fabric substrate (having a weight of 1.22 gm per 99 sq. in. (approximately 639 $cm^2$) and a fabric treatment composition is prepared in the following manner.

A fabric softening agent premixture is initially prepared by admixing 1608 parts octadecyldimethylamine with 1488 parts $C_{16}$–$C_{18}$ fatty acid at 70° C. The softening agent mixture is completed by then adding and mixing in a premixture of 1297 parts sorbitan monostearate and 1297 parts ditallowdimethylammonium methylsulfate at 70° C. To the softening agent mixture, 3425 parts of premelted anionic Soil Release Agent III at 85° C. is added slowly and with high shearing to finely disperse the anionic soil release agent. After the addition is completed and a sufficient period of mixing time has elapsed, 610 parts of Bentolite L particulate clay is added slowly while maintaining the high-shear mixing action. 275 parts of perfume are added to complete the preparation of the fabric conditioning composition.

The flexible substrate, comprised of 70% 3-denier, 1-9/16 inch (approximately 4 cm) long rayon fibers and 30% polyvinyl acetate binder, is impregnated by coating one side of a continuous length of the substrate and contacting it with a rotating cylindrical member which serves to press the liquified mixture into the interstices of the substrate. The substrate is passed over several chilled tension rolls which help solidify the conditioning mixture. The substrate sheet is 9 inches (approximately 28 cm) wide and is perforated in lines at 11 inches (approximately 28 cm) intervals to provide detachable sheets. Each sheet is cut with a set of knives to provide three evenly spaced parallel slits averaging 4 inches (approximately 10 cm) in length.

What is claimed is:

1. An article of manufacture adapted for use to provide fabric soil release benefits and to soften fabrics in an automatic laundry dryer comprising:

I. fabric treatment composition comprising:

(a) at least an effective amount of fabric conditioning agent selected from the group consisting of cationic fabric softening agents, nonionic fabric softening agents, and mixtures thereof; and (b) at least an effective amount of at least one anionic polymeric soil release agent having at least one hydrophobic moiety and at least one hydrophilic anionic moiety; and II. dispensing means which provides for release of an effective amount of said fabric conditioning agent (a) and anionic polymeric soil release agent (b) to fabrics in an automatic laundry dryer at operating temperatures, said agents (a) and (b) being, as they appear in the article of manufacture, substantially solid under storage conditions and being mobilized under dryer conditions.

2. The article of manufacture of claim 1 in which, as a percentage of said fabric treatment compositon, (a) is from about 20% to about 95% and (b) is from about 1% to about 70%; in which said hydrophilic anionic moiety comprises one or more covalently bonded anionic groups comprising compatible cations; and in which said dispensing means is a flexible substrate.

3. The article of manufacture of claim 2 wherein said anionic polymeric soil release agent comprises at least one hydrophobic moiety comprising alternating terephthaloyl groups and groups having the formula —ORO— wherein each R is an alkylene group containing from 2 to about 6 carbon atoms, and at least one hydrophilic anionic moiety comprises at least one sulfonate group.

4. The article of manufacture of claim 3 wherein said anionic polymeric soil release agent has the empirical formula comprising:

$$(CAP)_x(AO)_y(T)_z(I)_q(E_n)_r$$

wherein (I) Each (CAP) represents an end-capping moiety selected from a group consisting of (a) sulfoaroyl groups; (b) groups having the formula $MO_3S\text{-}(O)_u\text{-}(RO)_v\text{-}$ wherein each M is a compatible cation; R is either ethylene or a mixture of ethylene and propylene, u is 0 or 1, and v is from 1 to about 100; (c) poly(oxyethylene) monoalkyl ether groups wherein the alkyl group contains from 1 to about 6 carbon atoms and the poly(oxyethylene) portion contains from about 2 to about 200 oxyethylene units; and (d) mixtures thereof, and x is from 0 to 2;

(II) Each (AO) represents an oxyalkyleneoxy group containing from 2 to about 6 carbon atoms and y is from about 1 to about 80;

(III) Each (T) represents a terephthaloyl group and z is from about 1 to about 50;

(IV) Each (I) represents an internal anionic group and q is from 0 to about 30; and (V) Each ($E_n$) represents a poly(oxyethylene)oxy group containing from 2 to about 100 oxyethylene units and r is from 0 to about 25, there being at least one hydrophilic anionic moiety present, said anionic polymeric soil release agent having an average molecular weight of from about 500 to about 40,000.

5. The article of manufacture of claim 4 wherein r is either 0 or from about 1 to about 2.

6. The article of manufacture of claim 5 wherein substantially all (CAP) groups are sulfoaroyl groups and x is from about 1 to about 2; (AO) is a 1,2-oxyalkyleneoxy and y is from about 1 to about 10; z is from about 1 to about 10; (I) is a 5-sulfoisophthaloyl group and q is from 0 to about 5; and n is from about 6 to about 100.

7. The article of manufacture of claim 6 wherein substantially all (CAP) is the sodium salt of a sulfobenzoyl end-capping group, (AO) is selected from the group consisting of oxyethyleneoxy units; oxy-1,2-propyleneoxy units; and mixtures thereof; y is from about 1.25 to about 8, and z is from about 1.25 to about 8, with x, y and z being the average values.

8. The article of manufacture of claim 7 wherein the mole ratio of oxyethylenoxy to oxy-1,2-propyleneoxy groups is from about 1:1 to about 7:1, and z is from about 2 to about 7; said anionic polymeric soil release agent having a molecular weight of from about 800 to about 10,000.

9. The article of manufacture of claim 6 wherein substantially all of said anionic polymeric soil release agent contains 2 moles of sulfoaroyl end-capping groups.

10. The article of manufacture of claim 4 wherein said anionic polymeric soil release agent has a melting point of less than about 80° C.

11. The article of manufacture of claim 4 wherein said anionic polymeric soil release agent has a melting point of at least 110° C.

12. The article of manufacture of claim 5 wherein said anionic polymer soil release agent contains per mole from about 1 to about 2 moles of end-capping groups having the formula $MO_3S(RO)_v$ wherein M is a compatible cation, R is either ethylene or a mixture of ethylene and propylene.

13. The article of manufacture of claim 12 wherein substantially all of said anionic polymeric soil release agent contains 2 moles of said end-capping units, and R is substantially ethylene.

14. The article of manufacture of claim 12 wherein substantially all of said anionic polymeric soil release agent contains 2 moles of said end-capping units, v is from about 1 to about 15 and the molecular weight of said anionic polymeric soil release agent is less than about 4,000.

15. The article of manufacture of claim 12 wherein v is from 1 to about 15.

16. The article of manufacture of claim 4 wherein said anionic polymeric soil release agent comprises negatively charged 5-sulfoisophthalate groups in the polymer backbone and 1 or 2 poly(oxyethylene) monoalkyl ether end-capping groups.

17. The article of manufacture of claim 3 wherein said anionic polymeric soil release agent is a copolyester of ethylene glycol; poly(ethylene glycol) having an average molecular weight of from about 200 to about 3,400; aromatic dicarboxylic acid, or ester thereof; and sulfonated aromatic dicarboxylic acid, or ester thereof; said copolymer having a molecular weight of from about 1,000 to about 20,000.

18. The article of manufacture of claim 3 wherein said anionic polymeric soil release agent is a cooligomer or copolymer of sulfobenzoic acid, or ester thereof; terephthalic acid, or ester thereof; and an alkylene glycol selected from the group consisting of ethylene glycol, propylene glycol, or mixtures thereof.

19. The article of manufacture of claim 3 wherein said anionic polymer soil release agent is a cooligomer or copolymer of sulfobenzoic acid, or ester thereof; terephthalic acid, or ester thereof; poly(ethylene glycol) having an average molecular weight of from about 200 to about 9,000; and an alkylene glycol selected from the group consisting of ethylene glycol, propylene glycol, or mixtures thereof.

20. The article of manufacture of claim 3 wherein said anionic polymeric soil release agent is a cooligomer or copolymer of terephthalic acid, or ester thereof; $NaO_3S—(CH_2CH_2O)_n—H$ with n being from 1 to about 100; and an alkylene glycol selected from the group consisting of ethylene glycol, propylene glycol, or mixtures thereof.

21. The article of manufacture of claim 3 wherein said anionic polymeric soil release agent is a cooligomer or copolymer of terephthalic acid, or ester thereof; $NaO_3S—(CH_2CH_2O)_n—H$ with n being from 1 to about 100; poly(ethylene glycol) having an average molecular weight of from about 200 to about 9,000; and an alkylene glycol selected from the group consisting of ethylene glycol, propylene glycol, or mixtures thereof.

22. The article of manufacture of claim 1 wherein said fabric conditioning agent comprises a cationic fabric softener.

23. The article of manufacture of claim 22 wherein said fabric softening agent comprises a carboxylic acid salt of a tertiary alkylamine at a level of from about 5% to about 50% in combination with a fatty alcohol at a level of from about 10% to about 25% and a quaternary ammonium salt at a level of from about 5% to about 25%.

* * * * *